US009234285B2

(12) United States Patent
Rose-Petruck et al.

(10) Patent No.: US 9,234,285 B2
(45) Date of Patent: Jan. 12, 2016

(54) ELECTROCHEMICAL PROCESSING OF CLATHRATE HYDRATES

(71) Applicant: Brown University, Providence, RI (US)

(72) Inventors: Christoph Rose-Petruck, Barrington, RI (US); G. Tayhas R. Palmore, Providence, RI (US); Daniel DeCiccio, Providence, RI (US); Steven Ahn, Providence, RI (US)

(73) Assignee: Brown University, Providence, RI (US)

( * ) Notice: Subject to any disclaimer, the term of this patent is extended or adjusted under 35 U.S.C. 154(b) by 0 days.

(21) Appl. No.: 14/595,407

(22) Filed: Jan. 13, 2015

(65) Prior Publication Data

US 2015/0203972 A1 Jul. 23, 2015

Related U.S. Application Data

(60) Provisional application No. 61/928,477, filed on Jan. 17, 2014.

(51) Int. Cl.
*C25B 3/04* (2006.01)
*C25B 3/00* (2006.01)

(52) U.S. Cl.
CPC ..... *C25B 3/04* (2013.01)

(58) Field of Classification Search
CPC ..... C25B 3/00; C25B 3/04
USPC ..... 205/413, 440, 462
See application file for complete search history.

(56) References Cited

U.S. PATENT DOCUMENTS

| | | | |
|---|---|---|---|
| 7,833,644 | B2 | 11/2010 | Chokai et al. |
| 7,892,694 | B2 | 2/2011 | Nakano et al. |
| 8,277,634 | B2 | 10/2012 | Chen et al. |
| 8,419,913 | B2 | 4/2013 | Sato et al. |
| 8,574,758 | B2 | 11/2013 | Sumioka et al. |

OTHER PUBLICATIONS

Chapoy, et al., "Low-Pressure Molecular Hydrogen Storage in Semi-clathrate Hydrates of Quaternary Ammonium Compounds", J. Am. Chem. Soc., 2007, 129 (4), pp. 746-747.
Arjmandi, et al., "Equilibrium Data of Hydrogen, Methane, Nitrogen, Carbon Dioxide, and Natural Gas in Semi-Clathrate Hydrates of Tetrabutyl Ammonium Bromide", J. Chem. Eng. Data, 2007, 52 (6), pp. 2153-2158.
Li, H., Oloman, C., "Development of a continuous reactor for the electro-reduction of carbon dioxide to formate Part 2: Scale-up", Journal of Applied Electrochemistry, 37 (10), 2007, pp. 1107-1117.
Li, H.; Oloman, C., Development of a continuous reactor for the electro-reduction of carbon dioxide to formate—Part 1: Process variables, Journal of Applied Electrochemistry 36, 1105-1115 (2006).
(Continued)

*Primary Examiner* — James Lin
*Assistant Examiner* — Leo Ahnn
(74) *Attorney, Agent, or Firm* — Novak Druce Connolly Bove + Quigg LLP

(57) ABSTRACT

A method of using clathrate hydrates (including ammonia clathrates), in electrochemical transformations. Noted are converting clathrate guest molecules such as $CO_2$, $CH_4$, alkanes, and alkenes; and, optionally, the use of clathrates-promoting molecules such as tetra hydro furan, to produce higher value carbon molecules including propane and formic acid.

10 Claims, 4 Drawing Sheets

(56) References Cited

OTHER PUBLICATIONS

Papadimitriou et al., "Gas content of binary clathrate hydrates with promoters," The Journal of Chemical Physics 131 (4):044102 (2009).

Herslund, et al., "Thermodynamic Promotion of Carbon Dioxide Clathrate Hydrate Formation by Tetrahydrofuran, Cyclopentane and their mixtures", International Journal of Greenhouse Gas Control, 17, 2013, pp. 397-410.

Shin, K., et al., "Ammonia clathrate hydrates as new solid phases for Titan, Enceladus, and other planetary systems", Proceedings of the National Academy of Sciences, 109 (37), 2012, pp. 14785-14790.

ELECTROCHEMICAL PROCESSING OF CLATHRATE HYDRATES

CROSS-REFERENCE TO RELATED APPLICATION

This application claims priority to U.S. Patent Application Ser. No. 61/928,477, filed Jan. 17, 2014, the teachings of which are incorporated herein in their entirety.

STATEMENT OF GOVERNMENT RIGHTS

This invention was made with government support under CHE1240020 awarded by National Science Foundation. The government has certain rights in the invention.

FIELD OF THE INVENTION

Disclosed herein is a method of using clathrate hydrates including ammonia clathrates, in electrochemical transformations. Noted are converting clathrate guest molecules such as $CO_2$, $CH_4$, alkanes, alkenes, and the use of clathrate-promoting molecules such as tetra hydro furan, to produce C2 and C3 molecules and more such as propane, formic acid. Particular note is made of alkanes and alkenes with from 3 to 7 carbons, and more particularly with 3, 4 or 5 carbons.

BACKGROUND OF THE INVENTION

Clathrate hydrates are ice like substances that can store guest gases, typically $CO_2$, $CH_4$, and other small molecules. Reported clathrate hydrates store guest molecules in cages of hydrogen-bonded water molecules exist in cubic forms, and a tetragonal form. Clathrates are disclosed as accumulating high concentrations of $CO_2$. Clathrates take up these gases at appropriately low temperatures and gas pressures. Notably, 1 liter of clathrate slurry can contain about 11 liters of guest gas.

Under suitable thermodynamic conditions, gases with molecular diameters between 0.35 nm and 0.75 nm dissolved in water can transform into inclusion compounds where the gas solute molecules occupy sites in aqueous cage structures formed by the hydrogen bonded water molecules. Such inclusion compounds are known as clathrate hydrates. $CO_2$, $CH_4$, $N_2$, $SO_2$, NO, CO, $H_2$, and small (C2 and C3) hydrocarbons are among the gas phase species that can form stable clathrate hydrates. The formation of clathrates hydrates is often carried out close to ambient gas pressure facilitated by clathrate-promoter molecules, e.g., tetra hydro furan (THF), sodium dodecyl sulfate (SDS) propylene oxide, 1,4-dioxane, acetone, 1,1-dimethylcyclohexane, methyl tert-butyl ether (MTBE), and methylcyclohexane. Ambient gas pressure shall be understood to mean 1 atm equal to 101325 Pa or 1013.25 millibars or hectopascals. It also is equivalent to 760 mmHg (torr), 29.92 inHg, 14.696 psi. "Close" as applied to ambient pressure shall be understood to mean±about 50%. Cathrates are also produced without clathrate enhancers. Conveniently, such production occurs at pressures of tens of bar up to 150 bar. These promoters are usefully water miscible and thus dissolved in the water. In one embodiment clathrate hydrates are produced by cooling a solution of 10% THF (by weight) in water to approximately 2° C. The solution is exposed to $CO_2$ gas at ambient pressure (1 bar absolute).

The conversions products of the present invention are distinct from steam electrolytic conversions. The instant disclosure covers electrochemistry in the presence of clathrates. Clathrates do not exist at temperatures above about 10-15° C.

Catalysts may be employed in an embodiment of the basic process. However, catalysts are not a necessary for the basic process of employing clathrates in electrochemistry.

Porous electrodes are noted. Reference is made to Sumioka, et al. "Porous electrode substrate and method for producing the same," U.S. Pat. No. 8,574,758 and to Sato et al. "Porous electroconductive material and process for production thereof; electrode and process for production thereof; fuel cell and process for production thereof; and electronic instrument, mobile machine, electric power generating system, cogeneration system, and electrode reaction-based apparatus," U.S. Pat. No. 8,419,913. Nanoparticle coated electrodes are also noted. Reference is made to Chen et al, "Electrolytic water treatment device having sintered nanoparticle coated electrode and method for making acid or basic water therewith" U.S. Pat. No. 8,227,643; and Hosokowa et al, *Nanoparticle Technology Handbook*, Second Edition, Elsevier (2012).

Noted is the use of a flat copper electrode the faradaic efficiencies for higher hydrocarbon production, such as propane.

Clathrates hydrates can exist in aqueous or ammonia systems which are contemplated in the present disclosure. Reference is made to Chapoy, et al., "Low-Pressure Molecular Hydrogen Storage in Semi-clathrate Hydrates of Quaternary Ammonium Compounds," *J. Am. Chem. Soc.,* 2007, 129 (4), pp 746-747; and Arjmandi, et al. "Equilibrium Data of Hydrogen, Methane, Nitrogen, Carbon Dioxide, and Natural Gas in Semi-Clathrate Hydrates of Tetrabutyl Ammonium Bromide," *J. Chem. Eng. Data,* 2007, 52 (6), pp 2153-2158.

Clathrates are usefully produced in a continuous-flow reactor and used in a continuous-flow electrochemical cell. An embodiment is depicted in FIG. 1. There $CO_2$ is captured from a $CO_2$-rich gas stream, such as flue gas, in a scrubber reactor. The $CO_2$-loaded clathrates/water mixture has the consistency of slush. It is pumped into a chemical reactor cell where electrochemical or catalytic conversion of the trapped $CO_2$ gas is carried out. Once the clathrates are depleted of some or all of the $CO_2$, the slush is recycled back into the scrubber. Products produced in the electrochemical or catalytic reactor are continuously removed.

A diagrammatic electrochemical cell is shown in FIG. 2*a* and a flow cell in FIG. 2*b*

All publications cited herein are incorporated by reference in their entirety. Particular reference is made to the following publications, the teachings of which are incorporated herein by reference in their entirety:

1. *Clathrate Hydrates of Natural Gases*, Third Edition., Ed, Sloan et al., (CRC Press, Boca Raton Fla. (2008);

2. *Hydrates: Immense Energy Potential and Environmental Challenges* (Green Energy and Technology) by Carlo Giavarini and KeithHester (Springer; 2011);

3. M. M. Halmann, *Chemical fixation of carbon dioxide, Methods for recycling CO2 into useful products*, CRC Press (1993).

4. Li, H.; Oloman, C., "Development of a continuous reactor for the electro-reduction of carbon dioxide to formate Part 2: Scale-up." *Journal of Applied Electrochemistry* 37, (10), 1107-1117 (2007).

5. Li, H.; Oloman, C., Development of a continuous reactor for the electro-reduction of carbon dioxide to formate—Part 1: Process variables," *Journal of Applied Electrochemistry* 36, 1105-1115 (2006).

6. Papadimitriou et al., "Gas content of binary clathrate hydrates with promoters," *The Journal of Chemical Physics* 131(4):044102 (2009).

7. Sabil, Khalik M., "Phase behaviour, thermodynamics and kinetics of clathrate hydrate systems of carbon dioxide in presence of tetrahydrofuran and electrolytes," Diss. Ph. D. dissertation, Technische Universiteit Delft, Delft, Holanda, 2009.

8. Herslund, et al. "Thermodynamic Promotion of Carbon Dioxide Clathrate Hydrate Formation by Tetrahydrofuran, Cyclopentane and their mixtures," International *Journal of Greenhouse Gas Control* 17 (2013) 397-410.

9. "Ammonia clathrate hydrates as new solid phases for Titan, Enceladus, and other planetary systems," K. Shin, R. Kumar, K. A. Udachin, S. Alavi and J. A. Ripmeester, *Proceedings of the National Academy of Sciences* 109 (37), 14785 (2012)

10. Nakano et al., U.S. Pat. No. 7,892,694 "Electrolytic membrane, process for producing the same, membrane electrode assembly, fuel cell and method of operating the same"

11. Chokai, et al., U.S. Pat. No. 7,833,644 "Electrolytic membrane."

SUMMARY OF THE INVENTION

In one embodiment, the invention relates to a process for changing the oxidation state of a guest gas. In the practice of this invention, $CO_2$ can be reduced to higher-value hydrocarbons by electrochemically reacting an aqueous solution of $CO_2$ in an electrochemical cell. In other embodiments, products such as methane, formic acid, ethane and others are produced from the guest gas. Particularly noted is the use of clathrate hydrate slurries previously loaded with $CO_2$ guest gas. Clathrate hydrate slurries and high solubility/loading of guest gas yields increased reaction product.

In another embodiment the method converting one or more of Guest-Gas species selected from the group consisting of $CO_2$ or $CH_4$ to augmented-guest compounds (AGC) in an electrolytic cell comprising a cathode and an anode and electrolyte includes the steps of (i) Exposing a clathrate hydrate including a Guest-Gas species to a cathode in the presence of an electrolyte in said electrolytic cell at about 5 to about 40 Coulombs (ii) Producing AGC; and, in some instances (iii) Collecting said resulting AGC.

This invention includes method of converting one or more of Guest-Gas species selected from the group consisting of $CO_2$ or $CH_4$ to augmented-guest compounds (AGC) in an electrolytic cell comprising a cathode and an anode and electrolyte by the steps of a. Preparing clathrate hydrate to include a Guest-Gas species;
b. Exposing the Guest-Gas species to a cathode in the presence of an electrolyte in said electrolytic cell at about 5 to about 40 Coulombs producing AGC; and
c. Collecting said resulting AGC.

More particularly, when the Guest-Gas species is $CO_2$ the AGC may be any of methane, ethane and propane or formic acid or higher value hydrocarbon, and when the Guest-Gas species is $CH_4$ the may be any of ethane and propane or formic acid or higher value hydrocarbon.

Also contemplated in this method is an anode selected from the group comprising copper, nickel cobalt manganese; lithium iron phosphate; or divalent iron nitridophosphates.

Yet further contemplated is a cathode is selected from the group comprising of platinum, graphite, graphene, or zinc.

DETAILED DESCRIPTION OF THE INVENTION

Figure 1:
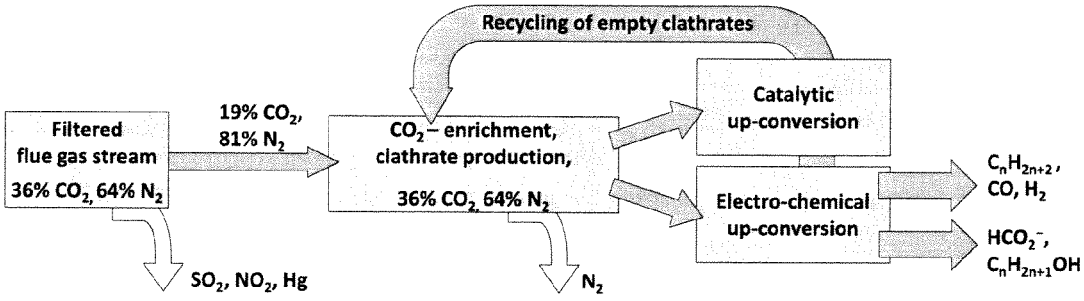
FIG. 1 is a diagrammatic representation of scheme for a particular embodiment employing clathrate hydrates in electrochemical transformations.

Electrolytic solutions that include clathrate hydrates have been used for the electrochemical conversion of $CO_2$ into higher-value chemicals. Clathrates hydrates in an electrochemical cell result in the creation of hydrocarbons. These hydrocarbons include those that are not be produced using electrolytic solutions without clathrates (e.g., propane).

Attention is drawn to copper electrodes. However, other electrode materials are contemplated including porous electrodes and nanoparticle coated electrodes. The choice of electrode materials depends, in part, on the desired products. Owing to the large $CO_2$ concentration in the clathrates hydrates, $CO_2$ gas bubbling over the working electrode is not typically necessary. This effect is in contrast to $CO_2$ conversion using an electrolytic solution. Without being bound by any particular theory, in that case the reactant concentration is lower and the solution is quickly depleted of $CO_2$, which requires continuous $CO_2$ availability (e.g., bubbling) in order to sustain the reaction for an extended time.

Clathrates are noted for entrapping guest gases. Most low molecular weight gases, including CO, NO, $O_2$, $H_2$, $N_2$, $CO_2$, $CH_4$, $H_2S$, Ar, Kr, and Xe, as well as some higher hydrocarbons and freons, will form hydrates at suitable temperatures and pressures. Clathrate hydrates do not form chemical bonds with the guest gas molecules. Instead the guest gas molecules are physically tapped in "water cages" that individually surround each guest gas molecule. Additionally noting that in reported instances more than one gas molecule is trapped.

Particular note is made of the following guest gas species that will be termed Guest-Gas species: $CO_2$ and $CH_4$.

Emphasis is placed on embodiments of the process which convert C1 (e.g., $CO_2$) to methane as well as C2, C3 or C4 products. "Augmented-Guest" Compounds ("AGC") shall mean reduction reaction products of Guest-Gas species converted to higher forms.

For example, $CO_2$ guest gas molecules introduced into an electrolytic cell without clathrates can be electrochemically reduced at the cathode to form higher hydrocarbons such as methane, C2-compounds such as ethane and ethane, and C3-compounds such as propene and propane. In a non-clathrate cell, higher hydrocarbons, if even produced, are produced with very low Faradaic efficiency. The use of clathrate hydrate containing electrolytes increases the yield for the production of C2, C3, and C4 or higher hydrocarbons. Furthermore, while hydrocarbons such as ethane that can be produced in electrolytes without clathartes, such hydrocarbons are produced at higher Faradaic efficiency in clathrate electrolyte systems described herein.

For example, in our experiments, no propane production was observed absent clathrates present in the electrolyte accompanied by stirring the solution. Without being bound by any particular theory it is believed that, with stirring, clathrate crystals made physical contact with the cathode (collided with the cathode). Notably, production of C3 hydrocarbons is enhanced by physical contact between clathrate crystals and the cathode, here copper.

It appears that the cathode (working electrode) material has a significant impact on the product materials. In some instances cathode materials will differ from anodes. Noted cathode materials include copper, nickel cobalt manganese; lithium iron phosphate; divalent iron nitridophosphates The anode is made of platinum or other materials including as graphite, graphene, zinc etc.

Promoter or thermodynamic promoter or clathrate promoter shall mean a component that participates actively in the hydrate formation process and readily enters the hydrate structure at higher temperature and lower pressure than in the unpromoted hydrate. Promoters are usually liquid organic substances (e.g., cyclic ethers, amines, and ketones). Promoters known to form hydrates by themselves are termed pure promoter hydrates, e.g., THE These form hydrates without the need for the presence of an additional guest gas. THF is also completely miscible with water. Ethylene oxide forms si hydrates and is soluble in water. Methyl cyclohexane (MCH) is a promoter for sH hydrates that is practically insoluble in water.

Promoters include tetra hydro furan (THF), sodium dodecyl sulfate (SDS) propylene oxide, 1,4-dioxane and acetone, methyl cyclohexane, 1,1-dimethylcyclohexane, methyl tert-butyl ether (MTBE), and methylcyclohexane.

Electrolytes shall be broadly construed to encompass a compound or mixture of compounds that ionize when dissolved in suitable ionizing solvents such as water. Particular note is made of potassium hydrogen carbonate The disclosed method usefully converts $CO_2$ to methane, ethane and propane, as well as higher hydrocarbons. Note is made of producing formic acid (HCOOH). Similarly, methane is converted to, ethane and propane, as well as higher hydrocarbons such as formic acid.

Electrolysis by the disclosed method is typically carried out in a temperature range below a few degrees Celsius where clathrates are stable. Depending on the guest gas and the electrolyte temperature, the guest gas pressure ranges from ambient to tens of bar pressure.

In one embodiment a total charge of 20 Coulomb was flowed through the cell. However, the absolute charge is generally not significant for the product compositions.

In particular embodiments, the anode side and cathode side of the cell were separated by a Nafion membrane (a sulfonated tetrafluoroethylene based fluoropolymer-copolymer) . The membrane is not a necessary condition for the invention to work. Without being bound by any particular theory it is believed that the membrane promotes oxidative species produced at that anode not reaching the cathode and then, degrading it through oxidation.

Both sides of the cell are usefully filled with clathrates. However, the presence of clathrates of the anode side is not necessary and an electrolytic solution without clathrates can be used there.

Clathrate hydrates can concentrate $CO_2$ up to 100 times the equilibrium concentration of $CO_2$ dissolved in a non-clathrate aqueous solution.

Note is made of the usefulness of insuring that the clathrates are in physical contact with the working (cathode) electrode. Physical contact between the electrode and clathrate is usefully achieved by stirring or mixing of the clathrate slush, or flowing the slush over the electrode. A compact packing of clathrate "snow" around the cathode is also contemplated. In some embodiments it is useful to structure the electrode surface in order to maximize the contact between the clathrate crystals and the electrode.

EXAMPLE 1

Propane Production form Electrolytic Reduction of Carbon Dioxide

Figure 2A:
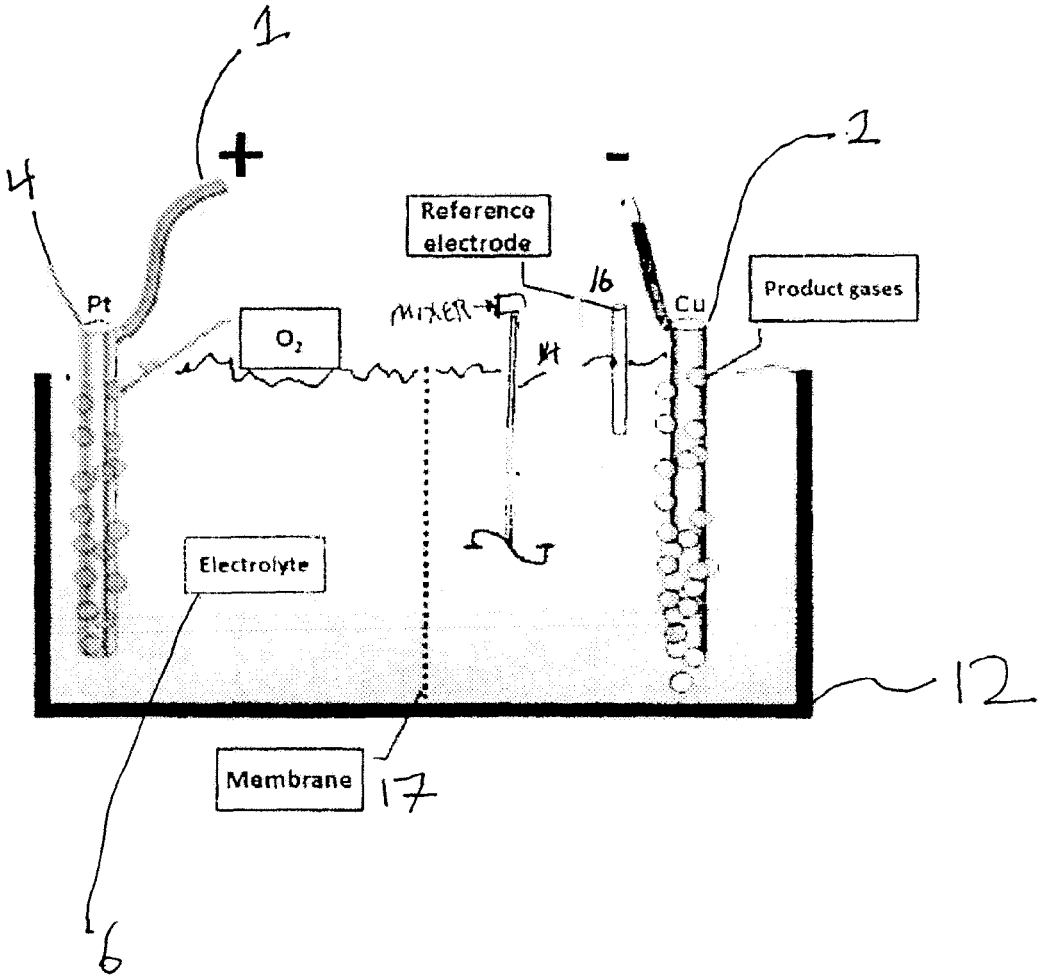
FIG. 2*a* is diagrammatic electrochemical cell.
Figure 2B:
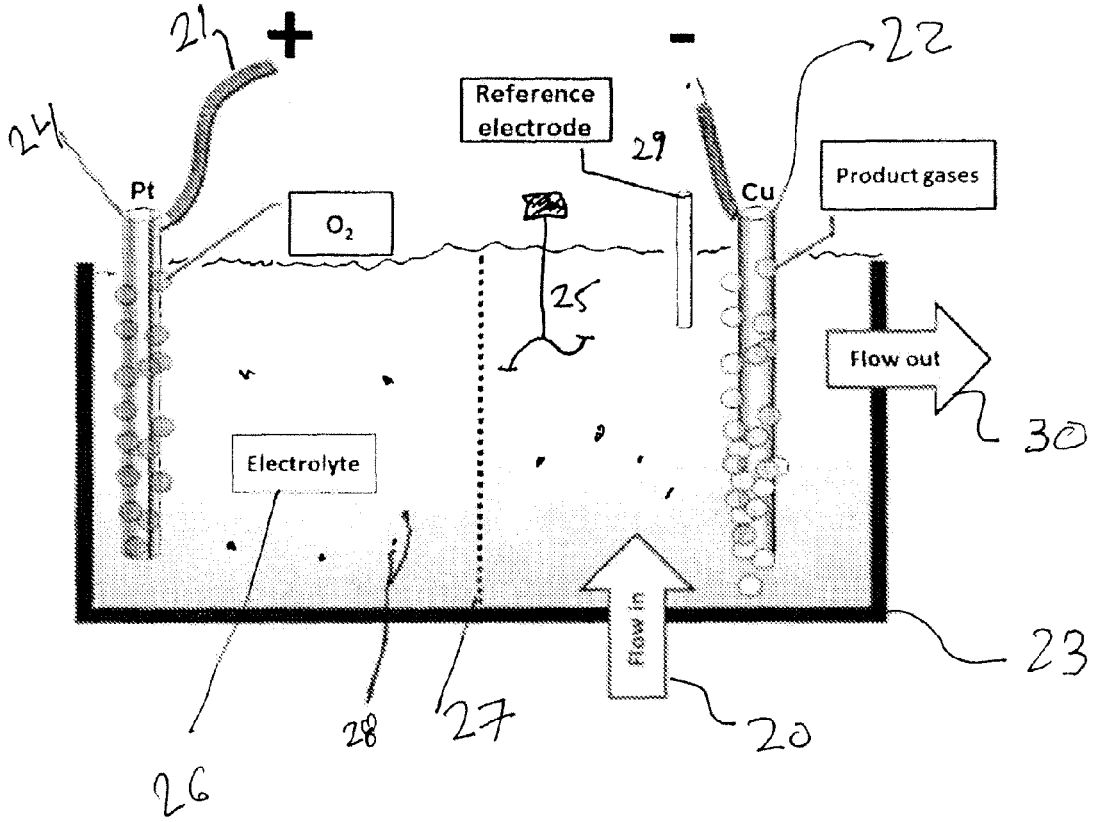
FIG. 2*b* is a diagrammatic representation of a flow cell.

The electrolytic reduction of carbon dioxide was carried out at in an electrolytic cell FIG. 2*b*. The electrochemical cell housing is (23) with a copper working electrode (22) and a platinum counter electrode (24), and lead from potentiostat (21) with a separatory membrane (27). Reference electrode is (29). The electrolyte solution (26) consisted of 0.1 M potassium hydrogen carbonate and tetra hydro furan (10% $_{mass}$) in water.

Clathrate formation: The presence of THF in the solution predisposes the water molecules to form clathrate hydrates (28) in the electrolyte. In fact, at 2° C. clathrates form around THF molecules even without any guest gas. These clathrates are constructed in such a way that empty cages are available that can be occupied by a guest gas such as $CO_2$. Direction of flow of clathrates containing electrolyte solution (Flow in, 20). Direction of flow of clathrates containing electrolyte solution is (Flow out, 30). Thus, exposing the clathrate slush to $CO_2$ will result in the uptake of the gas and the formation $CO_2$-containg clathrates. Clathrates also form within the chemical reactor (22) with refrigeration capacity to cool the contents to 2° C. A stirring auger (25) in the reactor continuously rotated in order to facilitate a good turnover of the clathrate slush and in order to prevent clathrates from freezing onto the inner glass walls for the reactor vessel. Reduced $CO_2$ exits the cell as $O_2$ via Flow out (30).

In some embodiments, all components, such as THF, bicarbonate, and nano-pure water, were poured into the reactor. The solutions had concentrations of potassium hydrogen carbonate of 0.1M and 10% by mass of tetra hydro furan was formed. The reactor was closed, and pressurized with $CO_2$ at a pressure of a few mbar relative to the ambient pressure. The reactor content was continuously stirred while cooling water flowed through a water jacket surrounding the reactor. After a few hours the content had cooled sufficiently to form $CO_2$-containg clathrates. These clathrate slushes were used in the electrochemical cell without further processing.

The experiments were performed at 2° C. and at 4° C. At 2° C. $CO_2$-loaded clathrates formed and were maintained during the electrolysis. The reduction potential was kept stable at a voltage in the range of 0 to −1.6V relative to an Ag/AgCl reference electrode (16) as shown in FIG. 2*a*. The electrochemical cell housing is (12) with a copper working electrode (2) and a platinum counter electrode (4), and lead from potentiostat (1) with a separatory membrane (17). Reference electrode is (16). The electrolyte solution is (6). An ion exchange membrane is shown as (17). A mixer/stirrer and motor is (14).

Figure 3:
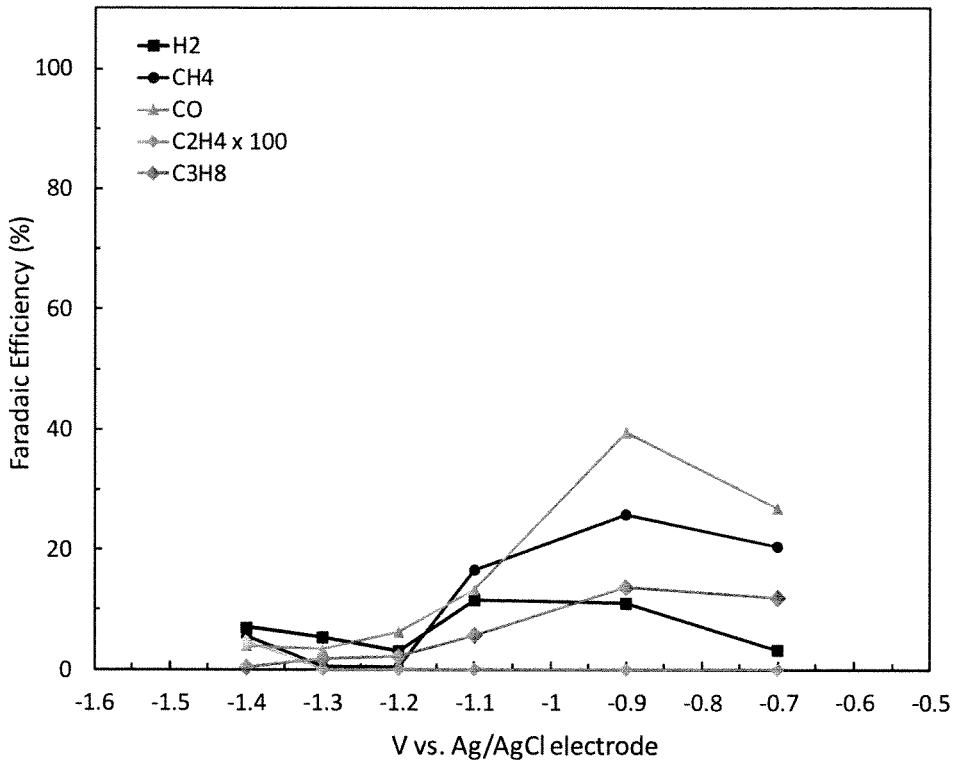
FIG. 3 is a plot of a typical product gas spectrum produced using a clathrate electrolyte.

The reference electrode (16) was located several millimeters form the platinum counter electrode (4). This resulted in a potential between the cathode and anode of approximately twice that between the cathode and deference electrode. The current varied depending on the reduction potential. A typical value was a few mA. Each electrolysis was run for 1800 seconds. Thus, the total charge flowed through the cell was about 20 Coulombs. Typically a few ml of product gas was produced. A sample from this gas was analyzed in a calibrated gas chromatograph, yielding the product spectra in FIG. 3.

These conditions were used to demonstrate the performance of the clathrates during electrolysis. Control experiments with melted clathrates were carried out at 4° C. The electrolysis carried out with clathrates hydrates in the electrolyte produced a different product composition than the same solution without clathrates. Specifically, propane was only produced in the presence of clathrates. A typical product gas spectrum produced using a clathrate electrolyte is shown in the FIG. 3 below.

Products detected were $H_2$, methane, ethane, ethylene, propane, formic acid (HCOOH), carbon monoxide (CO), hydrocarbons. It is believed that propane is only produced in the presence of clathrates.

The invention claimed is:

1. The method of converting one or more of Guest-Gas species selected from the group consisting of $CO_2$ or $CH_4$ to augmented-guest compounds (AGC) in an electrolytic cell comprising a cathode and an anode and electrolyte by the steps of:

a. preparing clathrate hydrate to include the Guest-Gas species;

b. exposing the clathrate hydrate including the Guest-Gas species to a cathode in the presence of an electrolyte in said electrolytic cell at about 5 to about 40 Coulombs to produce AGC; and c. collecting said resulting AGC.

2. The method of claim 1 wherein the Guest-Gas species is $CO_2$ and said AGC is selected from the group consisting of methane, ethane, propane, and formic acid.

3. The method of claim 1 wherein the Guest-Gas species is $CH_4$ and said AGC is selected from the group consisting of ethane, propane, and formic acid.

4. The method of claim 1 wherein said anode is selected from the group consisting of copper, nickel cobalt manganese, lithium iron phosphate, and divalent iron nitridophosphates.

5. The method of claim 1 wherein said cathode is selected from the group consisting of platinum, graphite, graphene, and zinc.

6. The method of converting one or more of Guest-Gas species selected from the group consisting of $CO_2$ or $CH_4$ to augmented-guest compounds (AGC) in an electrolytic cell comprising a cathode and an anode and electrolyte by the steps of:

a. exposing a clathrate hydrate including the Guest-Gas species to a cathode in the presence of an electrolyte in said electrolytic cell at about 5 to about 40 Coulombs b. producing AGC; and c. collecting said resulting AGC.

7. The method of claim 6 wherein the Guest-Gas species is $CO_2$ and said AGC is selected from the group consisting of methane, ethane, propane, and formic acid.

8. The method of claim 6 wherein the Guest-Gas species is $CH_4$ and said AGC is selected from the group consisting of ethane, propane, and formic acid.

9. The method of claim 6 wherein said anode is selected from the group consisting of copper, nickel cobalt manganese, lithium iron phosphate, and divalent iron nitridophosphates.

10. The method of claim 6 wherein said cathode is selected from the group consisting of platinum, graphite, graphene, and zinc.

* * * * *